United States Patent [19]

Wilson et al.

[11] Patent Number: 4,532,996

[45] Date of Patent: Aug. 6, 1985

[54] AUTOMATIC FIRE EXTINGUISHER WITH ACOUSTIC ALARM

[75] Inventors: Christopher W. Wilson; Thomas M. Trujillo; Dennis M. Zallen, all of Albuquerque, N. Mex.

[73] Assignee: The University of New Mexico, Albuquerque, N. Mex.

[21] Appl. No.: 528,315

[22] Filed: Aug. 31, 1983

[51] Int. Cl.[3] ..... A62C 35/02

[52] U.S. Cl. ..... 169/23; 169/26

[58] Field of Search ..... 169/46, 26, 20, 19, 169/30, 23, 42

[56] References Cited

U.S. PATENT DOCUMENTS

| | | | |
|---|---|---|---|
| 869,415 | 10/1907 | Buell | 169/20 |
| 1,491,301 | 9/1924 | Grafflin | 169/20 |
| 1,966,661 | 11/1932 | Doughty | 169/26 |
| 3,670,690 | 6/1972 | Swanson | 239/579 |
| 3,907,037 | 9/1975 | Linsalato et al. | 169/9 |
| 4,034,813 | 7/1977 | Le Day | 169/26 |

FOREIGN PATENT DOCUMENTS

| | | | |
|---|---|---|---|
| 568898 | 4/1924 | France | 169/46 |

*Primary Examiner*—Andres Kashnikow
*Assistant Examiner*—Kevin Patrick Weldon
*Attorney, Agent, or Firm*—Robert W. Harris

[57] ABSTRACT

An automatic fire extinguisher and alarm apparatus, particularly suitable for use with waste receptacles, which discharges fire extinguisher fluid when exposed to a fire and sounds an audible alarm. Fire extinguisher fluid is quickly discharged from a reservoir onto the fire when heat from the fire melts a fusible alloy plug. A second reservoir contains a partially gaseous alarm agent, and is connected through a valve to a vibrating diaphragm gas horn. The valve stem is connected to a diaphragm separating the two reservoirs. When pressure is lost in the first reservoir upon discharge of the fire extinguisher fluid, the pressure of the alarm agent in the second reservoir moves the diaphragm and valve stem and opens the valve, allowing alarm agent to be discharged through the gas horn, raising an audible alarm.

10 Claims, 3 Drawing Figures

AUTOMATIC FIRE EXTINGUISHER WITH ACOUSTIC ALARM

This invention was made with Government support under contract No. F29601-81-C-0013 awarded by the U.S. Air Force. The Government has certain rights in this invention.

BACKGROUND OF THE INVENTION

The present invention pertains to fire extinguishers with alarms, which are automatically activated by a fire so as to discharge fire extinguishing material and simultaneously raise an alarm to notify persons or systems of the existence of the fire. Such devices are particularly suitable for use with wastebaskets or other receptacles for flammable waste material, and for computer cabinets, though the present invention is not limited in application to such devices.

Earlier patents describe a number of fire extinguisher devices in which the heat from a fire automatically effects release of fire extinguisher material through the melting of a seal, fuse or plug, or by the rupturing of a diaphragm due to pressure of fire extinguisher material caused by the heat of the fire. In some of these devices, the escaping fluid passes through a whistle, tapered aperture or horn, so as to sound an audible alarm.

The patent of Linsalato (U.S. Pat. No. 3,907,037) discloses a disposable fire extinguisher in which pressurized fire extinguisher material is conveyed from a container through discharge tubes having orifices with caps normally held in place by fusible alloy seals. Upon exposure to heat from the fire the fusible alloy seals melt, allowing the pressurized fire extinguisher fluid to force the caps off the ends of the discharge tubes, whereupon the fire extinguisher fluid is discharged onto the fire. Col 2, lines 12–47; Col 3, lines 25–49; FIGS. 2, 3, 5, ref. Nos. 20, 54, 42, 44, 38, 40, 70 and 72. The patent states that previous fire extinguishers have used a meltable plug, fusible solder around a cover, or a band of fusible material to cause discharge of pressurized fire extinguisher fluid. Col. 1, lines 8–15.

The patent of Berti et al. (U.S. Pat. No. 3,536,139) discloses a fire extinguisher for a trash container in which release of fire extinguisher fluid is automatically effected by the melting of a fuse which normally holds one end of a lever arm under tension in a position such that the other end of the lever arm holds a valve stem in the valve closed position. When the fuse melts, the lever arms and valve stem are freed, allowing the valve to open under the pressure of the fire extinguisher fluid, so as to release the fluid to extinguish the fire. Col 2, lines 49–68; col 3, lines 16–36; FIGS. 5, 6, ref. Nos. 20, 22, 24, 40, 44, 36, 38, 12.

The patent of LeDay (U.S. Pat. No. 4,034,813) discloses a combined fire extinguisher and audible alarm in which pressurized fire extinguisher fluid is released into a waste receptacle when heat from the fire melts a seal, releasing a trigger, allowing the pressurized fluid to open a valve and exit a nozzle onto the fire. The fluid exits through tapered aperatures, producing an audible alarm. Col 1, lines 44–63; col 3, lines 27–68; FIG. 3, ref. Nos. 64, 62, 84, 84*a*, 86, 78, 76, 76*a*, 76*b*.

The patent of Hayes (U.S. Pat. No. 3,520,368) discloses an automatic fire alarm in which a container of pressurized fluid is exposed to heat from a fire, causing increased fluid pressure to rupture a diaphragm, allowing the fluid to escape through a whistle, thus sounding an alarm. Col 3, lines 7–36; FIG. 1, ref. Nos. 10, 11, 12*a*, 14 and 15.

Of course it is possible, in lieu of the means disclosed in LeDay and Hayes, to allow pressurized escaping gas to sound an alarm by having some portion of the gas activate a conventional gas-operated horn, such as the horns disclosed in the patents of Pappas (U.S. Pat. No. 3,757,731) or Swanson (U.S. Pat. No. 3,670,690).

One significant problem encountered in a device which simultaneously releases fire extinguisher fluid onto a fire, and also uses the escaping fluid to sound an alarm by passing through an appropriate whistle or horn, is a problem of timing. Obviously, it is desirable that the fire extinguisher fluid be released onto the fire fairly quickly, so that the fire can hopefully be overwhelmed and extinguished at its inception. But, on the other hand, it is desirable to have an audible alarm which will continue to sound for a longer time period, since a person may not be within earshot at the moment the alarm first sounds.

Another problem with such a device is the liquid versus gas phase problem concerning the fire extinguisher material and audio alarm activating material. Applicants' tests indicate that the use of fire extinguisher material such as Halon 1211 in liquid form is more effective for fire extinguishing than use of the gaseous form. Yet the use of gaseous material is preferable for purposes of operating an audible alarm, such as a conventional vibrating diaphragm gas horn.

Applicants' invention deals with these problems by providing 2 reservoirs, one containing fire extinguisher fluid in liquid form for fire extinguishing, and the other containing material at least partially in gaseous form, for operation of the gas horn, and by providing a mechanism which automatically causes gas from the second reservoir to flow through the gas horn when fire extinguisher material is released onto the fire from the first reservoir.

Another problem with conventional extinguisher-alarm devices such as those described above is that the fire extinguisher material may be lost due to a leak. If, for example, the heat sensing element and discharge tube of the device are located within or just above a waste receptable, such a leak may result from damage to the discharge tube occurring when some object is thrown into the waste receptacle, striking the discharge tube. It is desirable that there be a means of automatically calling attention to any loss of pressure of the fire extinguisher material. Applicants' invention also deals with this problem, since, as described below, gas will be released from the second reservoir through the gas horn if pressure is lost in the first reservoir due to a leak, as well as when pressure is lost because the fire extinguisher material is discharged onto a fire.

SUMMARY OF THE INVENTION

The present invention is a device which automatically functions as a fire detector, fire extinguisher, and acoustic fire alarm. The device, which may be mounted on the upper edge of a waste receptacle, is automatically activated by heat from the fire, so as to discharge fire extinguisher fluid onto the fire, and discharge gas through a gas horn, sounding an alarm.

The device has a first reservoir, holding a pressurized extinguishing agent such as Halon 1211, and a second reservoir, containing an alarm agent, a low boiling point liquid such as Freon 12 which is partially in the gaseous state. The two reservoirs are separated by a flexible diaphragm. The second reservoir is sealed by a valve connected by a rod to the diaphragm, and the first reservoir is initially filled with extinguishing agent at such pressure that the diaphragm and rod hold the valve in the closed position, preventing escape of the alarm agent from the second reservoir.

A tube leads from the first reservoir to an orifice, positioned just above a possible fire site (e.g. within and near the top of a trash receptacle), which orifice is normally sealed by a plug of fusible alloy. The second reservoir communicates through the valve with a passage leading to a gas horn, such as a vibrating diaphragm gas horn.

When the plug sealing the orifice is subjected to heat from a fire, the fusible alloy plug melts, and is ejected by the pressurized extinguishing agent. The extinguishing agent is then quickly discharged from the first reservoir onto the fire. The loss of pressure in the first reservoir allows the alarm agent in the second reservoir to move the diaphragm, rod, and valve toward the valve open position, opening the valve and allowing the alarm agent to escape through the gas horn, sounding an alarm. The alarm will also sound if pressure is inadvertently lost in the first reservoir by a leak.

The principal purpose of the invention is to provide a simple, inexpensive fire extinguisher and alarm unit which automatically detects a fire and discharges fire extinguisher agent while simultaneously sounding an audible alarm.

Another purpose of the invention is to provide such a device which will allow rapid release of fire extinguishing agent while also providing an acoustic alarm of longer duration.

Another purpose of the invention is to provide an acoustic alarm of known characteristics which can be detected by a physically separated electronic circuit which can send an electrical alarm signal to a remote location.

Another purpose of the invention is to provide an extinguisher and alarm unit which will sound an alarm in the event that the pressure of fire extinguisher agent contained in the unit is inadvertently lost through a leak.

DESCRIPTION OF THE PREFERRED EMBODIMENTS

Figure 1:
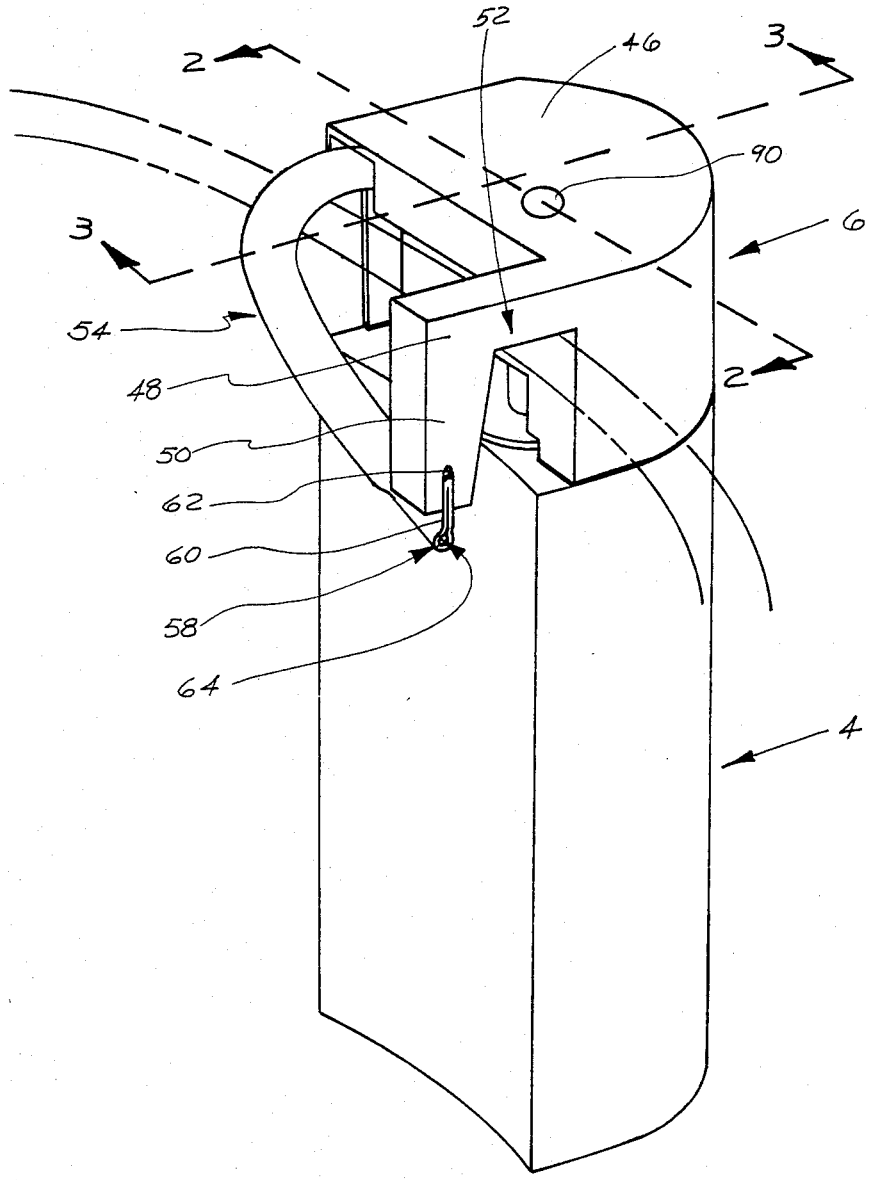
FIG. 1 is a perspective view of the invention.
Figure 2:
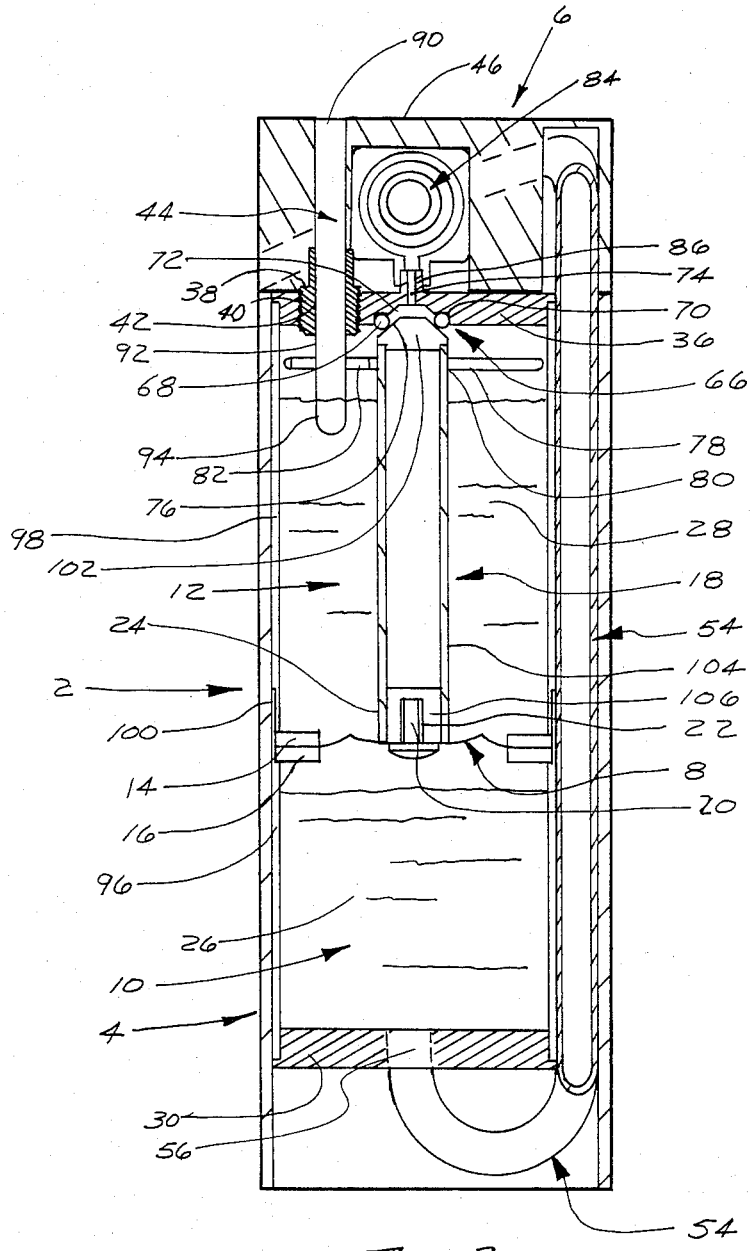
FIG. 2 is a sectional view of the section indicated by the line 2—2 in FIG. 1.
Figure 3:
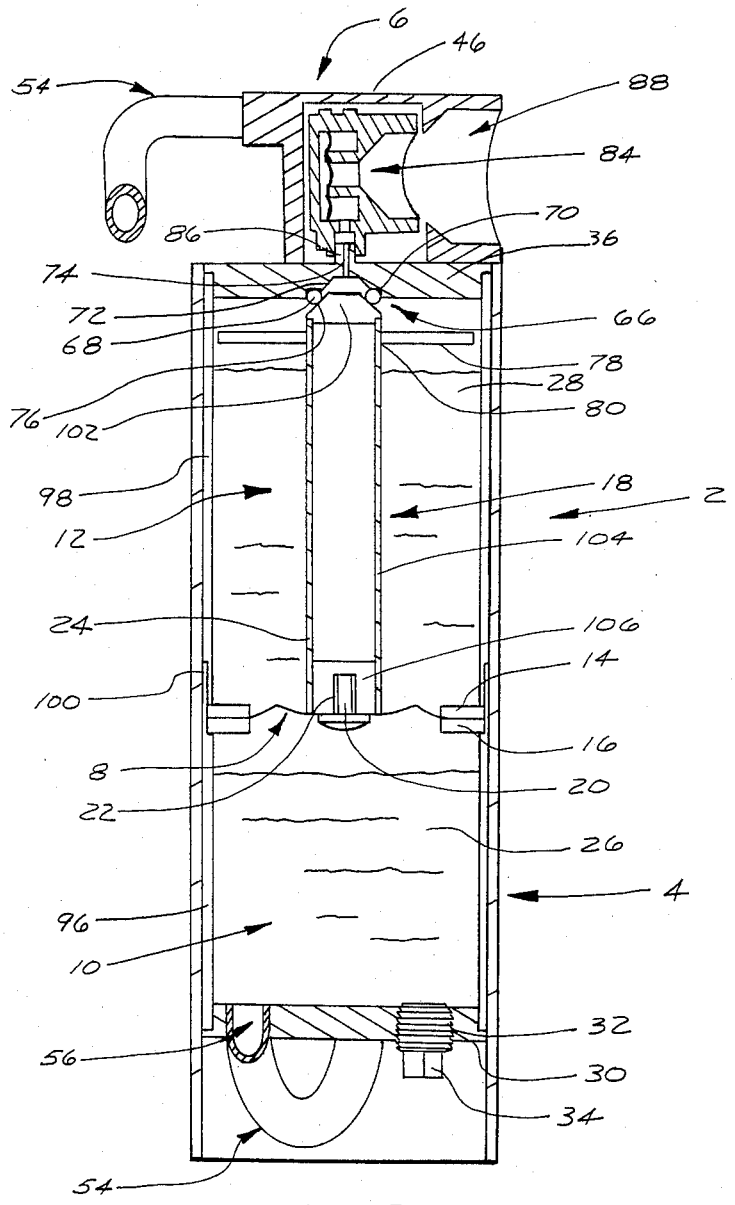
FIG. 3 is a sectional view of the section indicated by line 3—3 in FIG. 1.

Referring now to the drawings, wherein like reference numbers denote like or corresponding parts, the device has a cylindrical main body 2, a lower housing 4, and an upper housing 6.

The main body 2 is a closed cylinder which is divided by a circular diaphragm 8, thus forming a first reservoir 10 and a second reservoir 12.

The diaphragm 8 is secured between washers 14 and 16 on the inside wall of the cylindrical main body 2. The diaphragm 8 is attached at its center to a rod 18, by a screw 20 engaging a threaded hole 22 in the lower end 24 of rod 18.

The first reservoir 10 is used to contain an extinguishing agent 26, such as Halon 1211. The second reservoir 12 is used to contain an alarm agent 28, a low-boiling point liquid such as freon 12. Lower wall 30 of first reservoir 10 has a threaded first reservoir fill port 32 sealed by a threaded first reservoir fill port plug 34. Upper wall 36 of second reservoir 12 has a threaded second reservoir fill port 38 sealed by a threaded second reservoir fill port plug 40. Second reservoir fill port plug 40 has a hole 42 to accommodate an optical level indicator 44, discussed below.

The upper housing 6 comprises a central housing 46, to which is joined a discharge projection 48. The latter projects first radially outward from the central housing 46, and then downward, in an orifice support 50. The adjacent edges of the orifice support 50, central housing 46 and the upper surface of lower housing 4 together form a slot 52 which can be used to secure the device to the upper edge of a waste receptacle, with the main body 2 outside the waste receptacle and the orifice support 50 just inside, just below the upper edge of the receptacle.

A tube 54 connects a port 56 in the bottom of first reservoir 10 to an orifice 58 at the end of tube 54. Orifice 58 is held fixed with respect to orifice support 50, in that tube 54 has a flattened portion 60 just above orifice 58, which portion 60 snugly fits within a notch 62 in the lower end of orifice support 50.

Orifice 58 is normally sealed by a plug 64 of fusible alloy. In the preferred embodiment the fusible alloy is an alloy composed of 49% bismuth, 19% lead, 12% tin, and about 20% indium, which alloy has a melting point of 136° F. Applicants' tests indicate that fusible alloys with melting points between about 135° F. and about 200° F. are suitable for use for plug 64, in order to obtain acceptable response time, while avoiding undesired melting from high ambient temperatures sometimes encountered during transportation or storage.

A valve 66 at the top of second reservoir 12 comprises: an O-ring 68, seated within a groove 70 in a conical recess 72 in upper wall 36 of main body 2, said recess 72 terminating in a passage 74; and the conical end 76 of rod 18. Rod 18 thus serves as the valve stem for valve 66. A disk 78 serves to center rod 18 within second reservoir 12, to assure proper seating of valve 66. Disk 78 has a circular hole 80 for attachment to rod 18, of diameter equal to the diameter of rod 18, and a hole 82 through which optical level indicator 44 can be inserted. Hole 82 is larger than the diameter of optical level indicator 44, to facilitate flow of alarm agent 28 across disk 78.

Upper housing 6, besides housing a portion of tube 54, also houses a vibrating diaphragm gas horn 84, which connects to a nipple 86 at the terminus of passage 74, and an opening 88 leading from the outlet of gas horn 84 to the outside of upper housing 6. Upper housing 6 also has a hole 90 through which optical level indicator 44 may be viewed.

The pressure of the alarm agent 28 within second reservoir 12 urges diaphragm 8 in the downward direction, thus tending to move rod 18 downward. Such downward motion of rod 18 would separate conical end 76 and O-ring 68, and thereby open valve 66. However, first reservoir 10 is normally filled with extinguishing agent 26 at a sufficient pressure that the upward force exerted upon diaphragm 8 by extinguishing agent 26 exceeds the downward force exerted upon diaphragm 8 by alarm agent 28. The net upward force acting upon diaphragm 8 and rod 18 thus normally maintains valve 66 in the closed position, preventing escape of alarm agent 28 from second reservoir 12.

Passage 74 leads from the outlet (upper) side of valve 66 to gas horn 84. Gas horn 84 is a conventional vibrating diaphragm gas horn. Such a horn is suitable because it generates a loud signal of relatively constant audio frequency over a wide range of gas pressures and flow rates.

The optical level indicator 44 is simply a glass or other transparent rod 92 which extends to a point within second reservoir 12. The optical level indicator 44 detects the presence or absence of liquid at the lower end 94 of transparent rod 92, through differences in reflection or transmission of light at the lower end 94 of transparent rod 92, due to differences between the indices of refraction between the liquid and vapor states of alarm agent 28.

When a fire occurs within the waste receptacle, the hot combustion gases and infrared radiation impinging upon orifice 58 raise the temperature of fusible alloy plug 64 above the melting point of the fusible alloy. The pressurized extinguishing agent 26 then ejects fusible alloy plug 64 from orifice 58, and extinguishing agent 26 is quickly discharged through tube 54 and orifice 58 onto the fire. Because of the sudden loss of pressure in the first reservoir 10, the pressure of the alarm agent 28 in second reservoir 12 is able to move diaphragm 8 and rod 18 downward, thus opening valve 66, allowing alarm agent 28 to flow from second reservoir 12 through passage 74 to gas horn 84, thereby sounding an audible alarm.

The rate of discharge of extinguishing agent 26 from orifice 58 is, of course, determined and limited by the size of orifice 58, the length of tube 54, and the filling pressure of extinguishing agent 26. These parameters should be chosen to be such that a fairly rapid discharge of extinguishing agent 26 is effected, so as to hopefully extinguish the fire completely at its inception, while yet avoiding a discharge of such force as could eject burning material and ash from the waste receptacle. A tubing length for tube 54 is used which is adequate to prevent excessive heat transfer away from fusible alloy plug 64, which could otherwise prevent plug 64 from reaching its melting point. For a main body 24.25 inches long, a tubing length of 11.5 inches has been found adequate.

Frequently it will be desirable to employ the invention together with some electronic circuit which will detect the acoustic alarm generated by gas horn 84, and generate an electronic signal which may be used to provide a fire alarm for persons or systems at remote locations. Applicants have tested the present invention with a circuit which employs a microphone, to detect the acoustic alarm; an audio amplifier, to amplify the microphone output and establish a detection threshold; a frequency detector, to discriminate between the acoustic signal of gas horn 84 and extraneous noise; and timing circuitry, to establish that the audio signal has the proper time behavior to be a true signal from gas horn 84. This circuit, which is of different inventorship from the present invention, is the subject of U.S. patent application Ser. No. 06/541,860, entitled 'Tone Discrimination Circuit'.

The main body 2 of the invention, including the cylindrical wall, upper wall 36 and lower wall 30 are constructed of brass. Upper wall 36, including threaded second reservoir fill port 38, the conical recess 72 for valve 66, and passage 74, is machined from brass stock. Lower wall 30, including threaded first reservoir fill port 32, and port 56, is also machined from brass stock. The cylindrical wall of main body 2 is formed of two sections of brass tubing with overlapping shoulders, a lower section 96 and an upper section 98, joined at juncture 100. Rod 18 has been fabricated by joining a conical valve head 102, machined from brass stock, to a section of brass tubing 104. A cylindrical plug 106 is inserted in the lower end of tubing 104. Plug 106, containing threaded hole 22 for screw 20, is machined from brass stock. Disk 78 is machined from brass stock. Diaphragm 8 is formed from brass shim stock using a die. Tube 54 is formed from copper tubing. Orifice 58 at the upper end of tube 54 is formed by crimping the end of the tubing around a metal rod of the proper diameter, which is of smaller diameter than the inside diameter of tube 54. The excess material at the end of tube 54 is crimped to form flattened portion 60 of tube 54, which is inserted in notch 62 of orifice support 50.

Using a high temperature solder (700 degrees F.) tube 54 is soldered into port 56 of lower wall 30, lower wall 30 is soldered into the lower section 96 of main body 2, and upper wall 36 is soldered to the upper section 98 of main body 2. Using the same solder, rod 18 is assembled by soldering valve head 102 and cylindrical plug 106 to tubing 104. Rod 18 is inserted through hole 80 in disk 78, and disk 78 is soldered to rod 18 at the edges of hole 80. Diaphragm 8 is soldered to the bottom of rod 18, and is also attached to rod 18 by inserting screw 20 into threaded hole 22.

Using a low temperature solder washers 14 and 16 are soldered to the inside walls of lower section 96. The O-ring 68 is inserted into groove 70.

Lower section 96 and upper section 98 of main body 2 are soldered together at juncture 100 using low temperature solder.

Optical level indicator 44 is inserted through hole 42 in first reservoir fill port plug 34 and through hole 82 in disk 78. Optical level indicator 44 is glued into hole 42.

Orifice 58 at the upper end of tube 54 is sealed with 136 degrees F. solder.

Extinguishing agent 26 is inserted under pressure into first reservoir 10 through first reservoir fill port 32, and first reservoir fill port 32 is sealed with first reservoir fill port plug 34.

Alarm agent 28 is inserted into second reservoir 12 through second reservoir fill port 38, and upper reservoir 12 is sealed by insertion of second reservoir fill port plug 40 (with optical level indicator 44) into second reservoir fill port 38.

Upper housing 6 and lower housing 4 are machined from plastic. Gas horn 84 is a commercially available vibrating diaphragm gas horn, and is inserted into upper housing 6. Main body 2 is inserted into lower housing 4. Assembly of the device is then completed by gluing upper housing 6 and lower housing 4 together.

The device may be attached to the edge of a waste receptacle by using double adhesive tape applied to the inside edges of slot 52.

Those familiar with the art will appreciate that numerous changes may be made in the structural details of the device without compromising the essential functions of the invention.

1. In lieu of the fusible alloy plug 64 which detects the fire and releases the pressurized extinguishing agent 26 through orifice 58, one could instead use other means to accomplish the same results, including, for example, a mechanical fusible alloy spring retainer coupled to a release valve.

2. The vibrating diaphragm gas horn 84 could be replaced by other means for generating an acoustic alarm, such as whistles, resonating cavities, sonic converging and diverging nozzles, or vibrating reed devices.

3. In lieu of using the diaphragm 8 and rod 18 as the pressure coupling means for opening valve 66 when the pressure is lost in first reservoir 10, other means could instead be used. For example, diaphragm 8 could be replaced by a bellows or piston.

4. Instead of the configuration in which first reservoir 10 and second reservoir 12 are adjacent, separated only by diaphragm 8, one could employ a configuration in which the first reservoir 10 and second reservoir 12 are entirely separate, though connected by suitable means for opening valve 66 when pressure is lost in first reservoir 10.

5. Valve 66 may be entirely separate from second reservoir 12, although communicating with the reservoir, through tubing, for example.

6. Alternate forms of the lower housing 4 and upper housing 6 could instead be used for other applications, and there may be applications in which these housings may be eliminated.

7. Main body 2, first reservoir 10, and second reservoir 12 could be fabricated in other than cylindrical form; the cylindrical form is used in the preferred embodiment merely for ease of construction.

8. Main body 2 could be fabricated from a single cylindrical tube, rather than the two sections 96 and 98.

9. Rod 18 could be machined from a single piece of brass, rather than by joining valve head 102, brass tubing 104 and cylindrical plug 106.

10. Although brass has been used in fabricating main body 2 and other brass components described above, other metals or plastics of suitable strength could instead be used.

11. The device might be fabricated for certain applications without the reusable reservoir fill ports, first fill port 32 and second reservoir fill port 38. The charges of extinguishing agent 26 and alarm agent 28 may for certain applications be factory sealed for one-time use. Or first reservoir 10 may be filled through orifice 58 and tube 54, and second reservoir 12 may be filled through passage 74 and valve 66, while first reservoir 10 is yet unpressurized.

12. For certain applications tube 54 may be eliminated, with orifice 58 and fusible alloy plug 64 being located in a wall of first reservoir 10.

Other changes may be made in details of the structure of the invention, without departing from the essential substance and spirit thereof. The essential characteristics of the invention are defined in the following claims.

We claim:

1. Fire extinguisher and alarm apparatus, comprising:

(a) a first reservoir;

(b) an orifice, connected to said first reservoir;

(c) fire detection means, connected to said orifice, for maintaining said orifice closed in the absence of fire, and for opening said orifice when said fire detection means is exposed to heat from a fire;

(d) a second reservoir, connected to a valve;

(e) a flexible diaphragm communicating on one side of said diaphragm with said first reservoir, and communicating on the opposite side of said diaphragm with said second reservoir;

(f) pressure coupling means, connected to said valve and to said first reservoir, for opening said valve when pressure is lost in said first reservoir;

(g) acoustic alarm means, connected to said second reservoir through said valve, for generating an audible alarm signal upon flow of fluid through said acoustic alarm means.

2. The apparatus of claim 1, further comprising a tube connecting said orifice to said first reservoir.

3. The apparatus of claim 1 wherein said first reservoir further comprises a first reservoir fill port and a first reservoir fill port plug.

4. The apparatus of claim 1, wherein said fire detection means comprises a fusible alloy plug filling and sealing said orifice.

5. The apparatus of claim 4, wherein said fusible alloy plug has a melting point between about 135 degrees Fahrenheit and about 200 degrees Fahrenheit.

6. The apparatus of claim 1 wherein said second reservoir further comprises a second reservoir fill port and a second reservoir fill port plug.

7. The apparatus of claim 6 wherein said second reservoir fill port plug has a hole through said second reservoir fill port plug, further comprising a transparent tube passing through said hole and sealed to the edges of said hole, with the lower portion of said transparent tube extending into said second reservoir.

8. The apparatus of claim 1, wherein said pressure coupling means comprises a rod connected to said valve and to said diaphragm.

9. The apparatus of claim 8, wherein said first reservoir and said second reservoir are cylindrical and housed within a cylindrical main body.

10. The apparatus of claim 8, wherein said valve comprises an O-ring seated within a groove, and a conical valve head connected to said rod.

* * * * *